US005560058A

United States Patent [19]

Smith

[11] Patent Number: 5,560,058

[45] Date of Patent: Oct. 1, 1996

[54] SLEEPING SURFACE DIVIDER

[76] Inventor: James B. Smith, 238 Foxmoor Rd., Fox River Grove, Ill. 60021

[21] Appl. No.: 434,272

[22] Filed: May 3, 1995

[51] Int. Cl.[6] ..... A47C 21/00; A47G 5/00

[52] U.S. Cl. ..... 5/513

[58] Field of Search ..... 5/513, 658, 512

[56] References Cited

U.S. PATENT DOCUMENTS

| | | | |
|---|---|---|---|
| 1,432,383 | 10/1922 | Comings | 5/513 |
| 1,669,573 | 5/1928 | Pejka | 5/513 |
| 1,875,522 | 9/1932 | Sweet | 5/513 |
| 2,510,656 | 6/1950 | Randel | 5/513 |
| 2,555,905 | 6/1951 | St. Pierre | 5/513 |
| 2,556,913 | 6/1951 | Gilbert | 5/513 |
| 4,016,919 | 4/1977 | Zmijewski | 5/513 |

*Primary Examiner*—Alexander Grosz

[57] ABSTRACT

A sleeping surface divider that provides a shield between the heads and upper bodies of two people sleeping in one bed. The divider has two parts, a shield (FIG. 2) and a support part (FIG. 3). The shield is made of thick, soft and resiliant material and has a hole (1) cut into it for attaching the support. The support is also made of the same material and is used to hold the shield in a vertical position. The support has a cut out (2) in it which allows it to stand flat on the sleeping surface when inserted into the hole in the shield.

1 Claim, 1 Drawing Sheet

SLEEPING SURFACE DIVIDER

BACKGROUND-FIELD OF INVENTION

This invention relates to beds, specifically to a divider that provides a shield between people sleeping in a bed.

BACKGROUND-DISCUSSION OF PRIOR ART

In searching for prior an several patents were found which pertain to similar devices. The Breath Deflector in U.S. Pat. No. 4,016,919, to Zmijewski, 1974 Nov. 7, was intended for breath deflection and does not have much sound muffling capability. It also is made of folded material which needs to be refolded each time it is used making it more difficult to install and take out of the bed. The Bed Dividing Guard in U.S. Pat. No. 2,556,913 to Gilbert, 1949 Apr. 18, also does not have much sound muffling capability. The device is intended to be permanently installed which detracts from the beds appearance when not in use. It requires the mattress to be lifted up at the head end of the bed to install it. The prior an is only intended for breath deflection and not for sound muffling or ease of installing or removing.

OBJECT AND ADVANTAGES

Accordingly, several objects and advantages of the invention are; it reduces the sleeping disruptions that two people cause each other when sleeping together in a bed. In addition to deflecting breath it also buffers noise and motions that happen when two people sleep in one bed. It makes the sleeping environment more comfortable and helps to increase the amount and quality of sleep. It also is easier to install and remove from the bed. Further objects and advantages of the invention will become apparent from a consideration of the drawings and ensuing descriptions.

DESCRIPTION OF DRAWINGS

The drawings show several views of the sleep surface divider.

REFERENCE NUMBER IN DRAWINGS

1-Hole

2-Cutout

DESCRIPTION OF INVENTION

Figure 1:
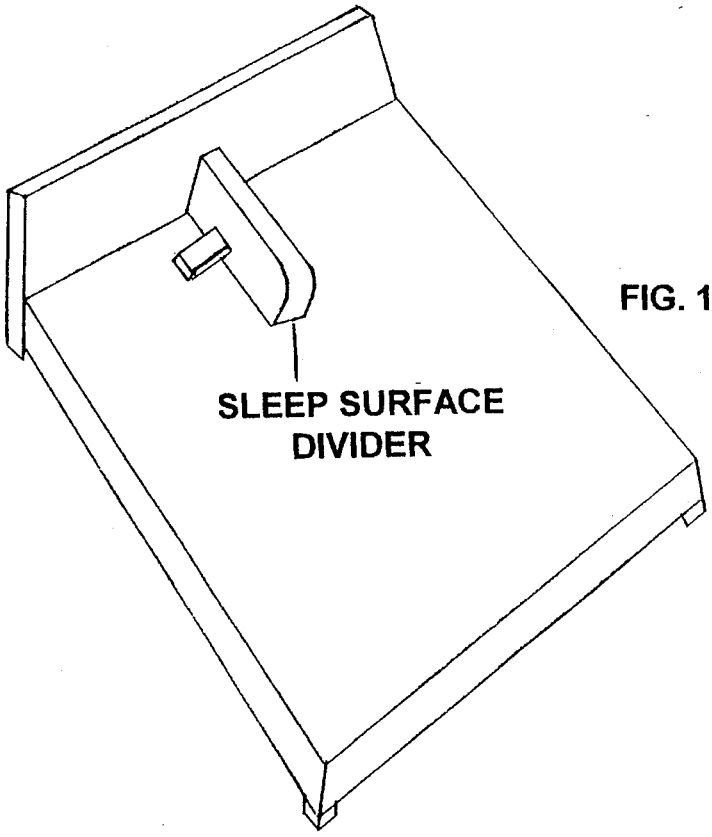
FIG. 1 Shows a bed with the sleep surface divider installed on it. The divider has a cross member support to hold it in vertical position.
Figure 2:
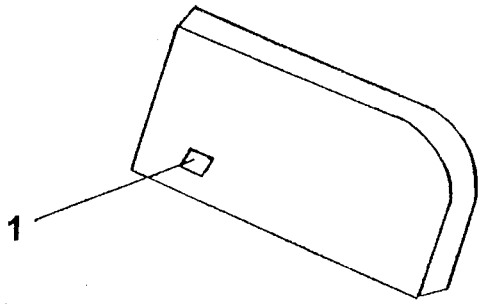
FIG.2 Shows a view of the shield part of the sleep surface divider with a hole 1 cut into it.
Figure 3:
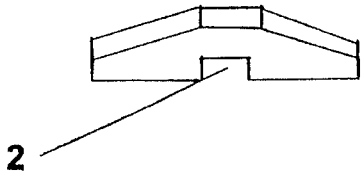
FIG. 3 Shows a view of the support part of the sleep surface divider with a cutout 2 in it.

The embodiment of the sleep surface divider is illustrated in FIGS. 1, 2 and 3. The shield shown in FIG. 2 is the main part of the sleep surface divider. It is made of thick, soft and resilient material of sufficient height and length to shield the head and upper bodies of two people sleeping in a bed. The thickness, softness and resilience of the material is important to provide needed sound absorbing capability. The shield FIG. 2 must be at least eight inches high, two feet long and two to three inches thick to provide needed shielding and sound reducing capability. The support part shown in FIG.3 is also constructed from thick, soft and resilient material and in a shape necessary to hold the shield in a vertical position. In FIG. 2 the shield shown has a hole 1 cut into it and the support has a cutout 2 cut into it. The support part is manually compressed to make it small enough to inserted through the hole 1 and nested tightly into the shield provide the support to hold the shield in a vertical position.

OPERATION-FIGS. 1, 2 and 3.

When in use, the sleep surface divider as shown in FIGS. 1, 2 and 3, is placed in the center and at the head of the bed. The shield part FIG. 2 between the pillows and the support part FIG. 3 under the pillows. The occupants of the bed lay one on each side of the shield FIG. 2. The shield FIG. 2 forms a barrier between the two people in the bed and prevents air, moisture, bacteria and viruses from passing directly from one person to the other. The shield FIG. 2 also buffers noise and motions that happen when two people sleep in one bed. It also can help to shield out light from clocks, televisions and other sources. The support FIG. 3 is used to hold the shield FIG. 2 in a vertical position between the two people in the bed. The sheets and blankets that cover the occupants can be placed under the shield FIG. 2 or around or partially over it. The sleep surface divider is easy to install and remove from a bed without folding or heavy lifting by simply picking it up with one hand and placing it in, or out of a bed.

As discussed above, and as seen in Figures, the, sleep surface dividers is adapted to be removably positioned on the sleeping surface of a bed, between two user of a bed, and is of a sufficient height and length to shield the head and upper bodies of the users of the bed, and comprised of a vertically positioned shield portion made of a thick, soft and resilient material, having first and second, generally parallel, sides with a hole formed therethrough, and a support portion made from a compressible material that is adapted to be manually compressed sufficiently to be removably inserted through said, whereby when the support portion is positioned through the hole in the shield portion such that one part of the support portion is on the first side of the shield portion and another part of the support portion is on the second side of the shield portion, the sleep surface divider is stably supported on the sleeping surface.

I claim:

1. A sleep surface divider, adapted to be removably positioned on the sleeping surface of a bed, between two users of a bed, of a sufficient height and length to shield the head and upper bodies of the users office bed, comprising a vertically positionable shield portion made of a thick, soft and resilient material, having first and second, generally parallel, sides with a hole formed therethrough, and a support portion made from a compressible material that is adapted to be manually compressed sufficiently to be removably inserted through said hole, whereby when the support portion is positioned through the hole in the shield portion such that one part of the support portion is on the first side of the shield portion and another part of the support portion is on the second side of the shield portion, the sleep surface divider is stably supported on the sleeping surface.

* * * * *